United States Patent [19]
Sato et al.

[11] Patent Number: 4,472,482
[45] Date of Patent: Sep. 18, 1984

[54] ELECTRIC IMPLEMENT COATED WITH ELECTRICALLY INSULATING MATERIAL AND THE METHOD OF APPLYING SAID ELECTRIC INSULATION

[75] Inventors: Kenichi Sato; Hikaru Okunoyama, both of Yokohama, Japan

[73] Assignees: Tokyo Shibaura Denki Kabushiki Kaisha, Kawasaki; Toshiba Chemical Products Co., Ltd., Tokyo, both of Japan

[21] Appl. No.: 405,083

[22] Filed: Aug. 4, 1982

[30] Foreign Application Priority Data

Sep. 19, 1981 [JP] Japan ..... 56-147006

[51] Int. Cl.[3] ..... B05D 3/06
[52] U.S. Cl. ..... 428/377; 427/54.1; 427/116; 428/383
[58] Field of Search ..... 427/44, 54.1, 11 C; 428/377, 383; 156/185

[56] References Cited

U.S. PATENT DOCUMENTS

| | | | |
|---|---|---|---|
| 2,829,191 | 4/1958 | Rogers | 427/116 |
| 3,531,751 | 9/1970 | Sargent | 156/185 |
| 3,778,536 | 12/1973 | Smearing | 156/185 |
| 3,813,294 | 5/1974 | Dyer et al. | 427/116 |
| 3,937,855 | 2/1976 | Gruenwald | 427/54.1 |
| 4,033,805 | 7/1977 | Mitsui et al. | 156/185 |
| 4,073,835 | 2/1978 | Otsuki et al. | 264/22 |

*Primary Examiner*—John H. Newsome
*Attorney, Agent, or Firm*—Oblon, Fisher, Spivak, McClelland & Maier

[57] ABSTRACT

An electric implement having a combination of insulation coverages comprising a thermosetting resin impregnated in an insulation layer wound about the electric implement, and a photohardening resin deposited over the impregnated thermosetting resin. A method of electrically insulating the electric implement, comprising impregnating the insulation layer with a thermosetting resin in vacuum; depositing a photohardening resin on the exposed portion of the thermosetting resin layer; photopolymerizing the photohardening resin; and thermosetting the impregnated thermosetting resin.

9 Claims, 5 Drawing Figures

ELECTRIC IMPLEMENT COATED WITH ELECTRICALLY INSULATING MATERIAL AND THE METHOD OF APPLYING SAID ELECTRIC INSULATION

BACKGROUND OF THE INVENTION

This invention relates to a coil of, for example, an electric implement coated with electrically insulating plastics material and a method of applying said electrically insulating plastics material.

The conventional process of electrically insulating an electric implement coil generally comprises winding the coil with, for example, an electrically insulating material to provide an electric insulation layer, impregnating said electric insulation layer with thermosetting resin in vacuum, and later thermally hardening said resin.

The object of impregnating thermosetting resin in an electric insulation layer formed of, for example, an electrically insulating tape is intended to meet the undermentioned requirements.

(1) For example, moisture or dust tends to be carried into an electric insulation layer if formed of only an electrically insulating tape. Therefore, it is desired to prevent the intrusion of such undesirable foreign matter in order to more effectively save an electric implement from moisture and contamination.

(2) It is necessary to eliminate the presence of void spaces in the electric insulation layer, thereby suppressing the occurrence of an electrically harmful corona.

(3) The heat conductivity of an electric implement should be elevated, to reduce the rate of temperature rise in the electric implement.

To thoroughly attain the above-listed objects, it is important that thermosetting resin be sufficiently impregnated in the electric insulation layer to eliminate the presence of any void space in said electric insulation layer.

However, the conventional process of effecting the above-mentioned electric insulation is accompanied with the drawbacks that while thermosetting resin impregnated in an electric insulation layer formed of, for example, an electrically insulating tape, is being hardened, said resin is temporarily reduced in viscosity by application of heat; and part of the impregnated resin flows out of the electric insulation layer, resulting in the occurrence of void space in said electric insulation layer, presenting considerable difficulties in fully attaining the aforementioned objects.

The conventional process of electric insulation has the drawbacks that a hardening agent, catalyst, monomer, etc. tend to scatter during a period in which a thermosetting resin is fully hardened, exerting harmful effects from the standpoint of meeting safety and sanitary requirements and preventing environmental pollution.

SUMMARY OF THE INVENTION

It is accordingly an object of this invention to provide a method of electrically insulating an electric implement which is saved from the above-mentioned drawbacks accompanying the conventional process of electric insulation and prevents void spaces from appearing in an insulation layer such as an electric insulation tape wound about, for example, a coil of an electric implement with the possible occurrence of gaps due to the undesirable efflux of thermosetting resin impregnated in said loosely wound insulation layer.

Another object of the invention is to provide a method of electrically insulating an electric implement which can eliminate harmful effects from the standpoint of meeting safety and sanitary requirements and preventing environmental pollution.

To attain the above-mentioned object, this invention provides an electric implement which is constructed by impregnating or coating an electric insulation layer loosely wound about the peripheral surface of said electric implement with thermosetting resin, and is further characterized in that a layer of photohardening resin is laid on the outer surface of said impregnated or coated thermosetting resin layer.

Further object of the invention is to provide a method of electrically insulating an electric implement which comprises the steps of:

impregnating thermosetting resin in vacuum in an electric insulation layer loosely wound about the outer peripheral wall of the electric implement;

coating a layer of photohardening resin with atmospheric pressure on the outer peripheral wall of the electric implement which is impregnated with the thermosetting resin;

effecting the photopolymerization of said coated photohardening resin by irradiating ultraviolet rays thereon; and hardening said impregnated thermosetting resin by heat treatment.

DETAILED DESCRIPTION OF THE PREFERRED EMBODIMENTS

Figure 1:
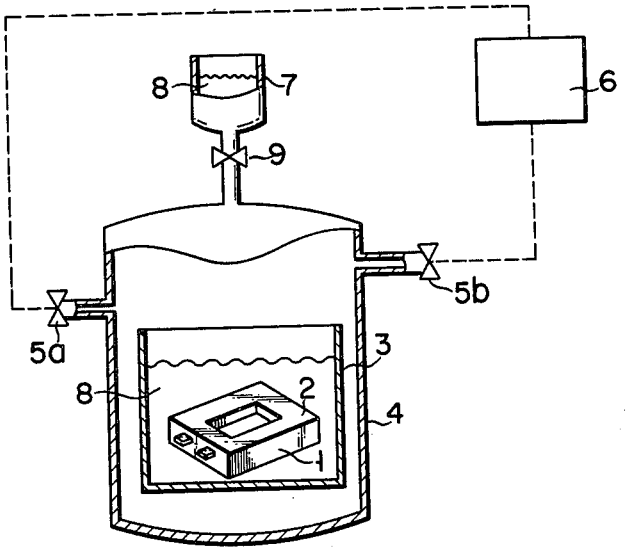
FIG. 1 typically illustrates the process of impregnating thermosetting resin in an electric insulation layer in accordance with an embodiment of this invention.

Detailed description is now given with reference to the accompanying drawings of an electric implement coated with electrically insulating material and a method of effecting said electric insulation according to this invention. Referring to FIG. 1, reference numeral 1 denotes an insulated electric coil loosely wound with an electric insulation layer 2 formed of, for example, an electric insulation tape. The electric coil 1 is placed in an electric insulation material-impregnating vessel 3, and in this state is securely held in a vacuum vessel 4 by proper means. Air remaining in the vacuum vessel 4 is slowly drawn out through valves 5*a*, 5*b* by the action of an external device 6 for supplying and discharging air. As a result, the interior of said vacuum vessel 4 is progressively evacuated, due to a decline in the pressure prevailing therein. While the above-mentioned evacuating process is proceeding, thermosetting resin 8 for impregnation held in a tank 7 set in the upper part of the vacuum vessel 4 falls from the ceiling of the vacuum vessel 4 into the impregnation vessel 3 by the opening of a valve 9. As time goes on, the electric coil 1 placed in the vacuum vessel 4 is progressively impregnated with the thermosetting resin 8.

When the thermosetting resin 8 is fully impregnated in the electric insulation layer wound about the electric coil 1 by the above-mentioned impregnation process, air is supplied to the vacuum vessel 4 by the air charge-discharge device 6 to return the interior of said vessel 4 to the atmospheric condition.

Figure 2:
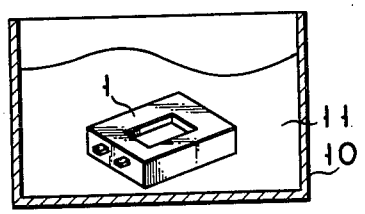
FIG. 2 typically illustrates the process of coating photohardening resin on a layer of said thermosetting regin.
Figure 3:
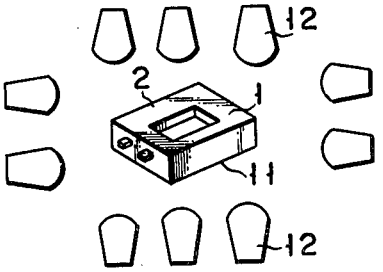
FIG. 3 typically indicates the process of carrying out the photopolymerization of said photohardening resin by irradiating ultraviolet rays.

The electric coil 1 impregnated with the thermosetting resin 8 is immediately taken out of the impregnation vessel 3 and vacuum vessel 4. The electric coil 1 thus impregnated is dipped in a bath of photohardening resin 11 (FIG. 2) filled in an immersion vessel 10. When fully impregnated with the photohardening resin 11, the electric coil 1 is taken out of the immersion vessel 10. Ultraviolet rays are irradiated in the surface of the electric insulation layer 2 from ultraviolet ray lamps 12 (FIG. 3) set around the electric coil 1 to harden the photohardening resin 11. The ultraviolet rays have to be irradiated only for several minutes, though depending on the content of a sensitizer in the photohardening resin 11. Even such extent of ultraviolet ray irradiation effects the photopolymerization crosslinking of said photohardening resin 11 deposited on the surface of the electric insulation layer 2. The crosslinking reaction given rise to the formation of a 3-dimensional mesh-like struction fully covering the thermosetting resin 8, thereby fully preventing said thermosetting resin 8 impregnated in the electric insulation layer 2 from leaking out.

Later, the electric implement 1 is placed in a thermostat (not shown), thereby thermally hardening said thermosetting resin 8. In this case, the shell of the photohardening resin 11 prevents the thermosetting resin 8 from leaking out, no matter how the viscosity of said thermosetting resin 8 may fall. Consequently, the thermosetting resin can be hardened slowly.

The thermosetting resin used in this invention is not particularly different from that which is used in the conventional electric insulation process of an electric implement. However, the preferred thermosetting resin is the type which is free from a solvent and has a viscosity of about 0.1 to 10 poises at 60° to 70° C. A thermosetting resin of low viscosity can be easily impregnated in the electric insulation layer 2. The viscosity of the thermosetting resin 8 can be reduced by heating said resin driving impregnation or applying a reactive diluent. After deposition, a thick coat of photohardening resin 11 having a higher viscosity (for example, 10 to 100 poises at ordinary temperature) than the thermosetting resin 8 can effectively suppress the natural leak of the low viscosity thermosetting resin 8, even before said photohardening resin 11 is hardened. The most preferred process of electrically insulating an electric implement comprises the steps of setting the temperature of the thermosetting resin 8 during impregnation at a higher level than that of the photohardening resin 11; decreasing the temperature of the thermosetting resin 8 when the electric coil 1 is impregnated with said photohardening resin 11; and controlling the viscosity of said thermosetting resin 8 in such a manner that said viscosity is set at a low level when said thermosetting resin 8 is impregnated, and at a high level when the electric coil is dipped in said thermosetting resin 8.

The thermosetting resin used in this invention may be prepared without limitation from any of a polyfunctional prepolymer, hardening agent applied in combination with said polyfunctional prepolymer and monomer. Epoxy resin may be cited as the typical one of these materials. The epoxy resin includes, for example, bisphenol A type glycidyl ether, alicyclic epoxy resin and novorac type epoxy resin. Any of these epoxy resin compounds may be applied in combination with an amine series hardening agent, acid anhydrous hardening agent, reactive diluent or hardening accelerating agent.

Needless to say, a large variety of said amine series hardening agents may be used with the epoxy resin. However, an amine complex compound of tetrafluoroboron and latent hardening agent such as dicyan diamide are also useful. The effective type of said acid anhydrous hardening agent includes, for example, one or more of polybasic acid anhydrides such as phthalic anhydride, hexahydrophthalic anhydride, methyl tetrahydrophthalic anhydride, methyl nadic anhydride, methyltetrahydrophthalic anhydride, maleic anhydride, dodecyl succinic anhydride and pyromellitic anhydride.

The aforementioned reactive diluent includes, for example, glycidyl methacrylate, allyl glycidyl ether and butane diol diglycidyl ether. These diluents are added in a small amount to a highly viscous resin which presents difficulties in being impregnated in an electric insulation layer, thereby reducing the viscosity of said resin to facilitate its impregnation.

The above-mentioned hardening accelerating agent includes, for example, benzyl dimethyl amine, tridimethyl aminomethyl phenyl, salts thereof, tertiary amines such as a-methyl benzyl dimethyl amine, or salts or complexes of transition metals such as zinc octylate and cobalt octylate. These hardening accelerating agents indicates a full effect, when added in an amount of generally 0.1 to 5 parts by weight to 100 parts by weight (hereinafter simply referred to as "parts") of epoxy resin.

A photohardening resin used in this invention includes a polymer or prepolymer whose molecule contains two or more unsaturated radicals. These polymeric compounds are used alone or, if necessary, with a vinyl monomer. A particularly preferred photohardening resin is the type whose molecule end contains a photopolymerizable cross-linking radical. The following compounds may be cited as preferred photohardening resins: methacrylates of polyhydric alcohol such as dimethacrylate of ethylene glycol, dimethacrylate of propylene glycol and dimethacrylate of polyethylene glycol; acrylic esters; and esters of acrylates or methacrylates of polyester olygomers whose molecule and contains a hydroxy radical, such as dimethyl acrylate of bis ($\beta$-hydroxylethyl) hexahydrophthalate, dimethyl acrylate of bis ($\beta$-hydroxylethyl) phthalate, and dimethyl acrylate of bis ($\beta$-hydroxylethyl) isophthalate. It is desired to add a small amount of a sensitizer to the above-mentioned photohardening resins. Said sensitizer includes the type which makes a particularly quick response to a light beam of a specified wavelength, such as quinone series compounds such as anthraquinone, and naphthoquinone, and disulfide compounds such as diphenyl disulfide. These sensitizers assure the full photopolymerization cross-linking of the aforesaid photohardening resins. Further, if necessary, peroxides may be applied in addition to the sensitizers.

This invention will be more apparent with the examples which follow. Throughout the examples, parts means parts by weight.

EXAMPLE 1

A dry transformer coil was wound with a glass tape having a thickness of 0.25 mm. The tape was wound four times in such a manner that the respective turns were displaced from each other by half the width. The tape-wound transformer coil was preheated at 100° C. for 12 hours. Later the mass was placed in a vacuum tank. The tape was impregnated with a thermosetting resin (having a viscosity of 0.9 poises at 60° C.) prepared by uniformly mixing 100 parts of bis phenol A type glycidyl ether (manufactured by Shell Chemical Company with a trademark "Epicoat 828") having an epoxy equivalent of about 190, 75 parts of a phthalate anhydride hardening agent (manufactured by Hitachi Kasei K.K. with a trademark "HN-2200") and 2 parts of zinc octylate. The tape-wound coil was dipped in a bath of photohardening resin (having a viscosity of 40 poises at 20° C.) prepared by uniformly mixing 100 parts of polyhydric $\beta$ hydroxyacrylate (manufactured by Show High Polymer K.K. with a trademark "Repoxy E-1000") 20 parts of ethylene glycol acrylate and 3 parts of benzoyn methyl ether applied as a sensitizer. The mass was fitted to a rotary jig set below a high pressure mercury lamp (80 W/cm). The jig was rotated at the rate of 10 turns/min to irradiate ultraviolet rays on the dipped tape. Later, the tape was dried 5 hours at 110° C. and 10 hours at 150° C. and was brought to room temperature by slow cooling.

EXAMPLE 2

A glass tape wound about the same kind of dry transformer as used in Example 1 was impregnated with the same kind of thermosetting resin as used in Example 1. The mass was dipped in a bath of photohardening resin prepared by uniformly mixing 100 parts of oligoester acrylate (manufactured by Toa Gosei K.K. with a trademark "alonix 8060"), 10 parts of glycidyl methacrylate and 2.5 parts of benzoin methyl ether used as a sensitizer. Hardening was carried out in the same manner as in Example 1.

CONTROL

A glass tape wound about the same kind of dry transformer as used in Example 1 was impregnated with a thermosetting resin prepared by mixing 100 parts of Epicoat 828, 75 parts of phthalic anhydride, and 2 parts of zinc octylate. The impregnated tape was dried for 5 hours at 110° C., and then slowly cooled to room temperature.

Figure 4:
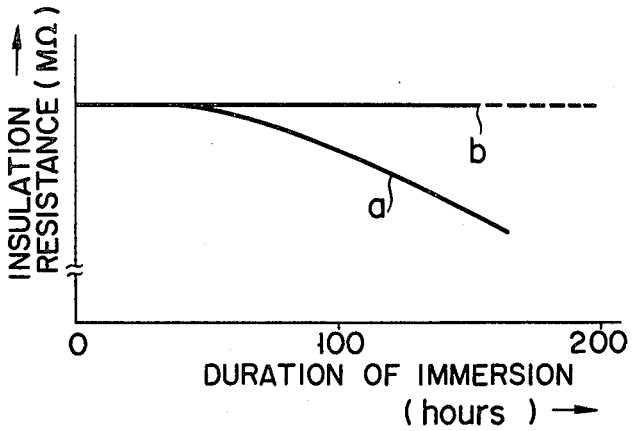
FIGS. 4 and 5 are curve diagrams showing a comparison between the characteristics of an electric implement electrically insulated by the method of this invention and those of an electric implement electrically insulated by the conventional method.

With the conventional electric insulation process based on the impregnation of only a thermosetting resin (represented by the above-described control), void phaces appeared in the electric insulation layer and its insulation property was gradually degraded with the increase in immersion time in water as shown by curve a of FIG. 4. In contrast, a transformer coil electrically insulated by the method of this invention was provided with an excellent electric insulation layer which indicated no change in insulation resistance even when dipped in water for 150 hours (as seen from curve b of FIG. 4).

Figure 5:
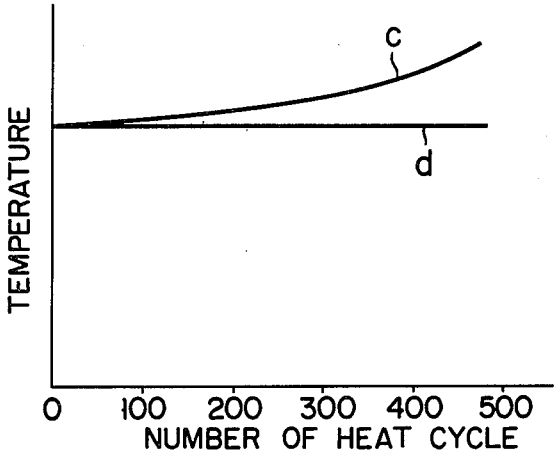

A prescribed number of heating cycles were applied to the transformer coil wound with the electric insulation tape at room temperature and 220° C. A prescribed amount of current was let to pass through the transformer coil, each time a prescribed number of heating cycles were carried out, thereby measuring a temperature rise in said coil (the result is shown in FIG. 5). With the conventional electric insulation process (represented by the foregoing control), conduction of current led to a prominent temperature rise in the transformer coil, as heating cycles increased in number as seen from curve C of FIG. 5. In contrast, the electric insulation process of this invention represented by Example 2 did not cause a passage of current through the transformer coil to give rise to a temperature rise therein, even when heating cycles increased in number as seen from curve d of FIG. 5, proving that the electric insulation process of the invention exerted a full effect.

As mentioned above, the electric insulation process of an electric implement according to this invention has the advantages that it is possible to suppress the leakage of a thermosetting resin impregnated in a tape wound about the electric implement, thereby enabling the electric implement to be electrically insulated with an excellent electric performance due to the absence of voids in the electric insulation tape; and the shell of a photohardening resin prevents harmful effects on the safety and sanitary requirements from being caused by the scattering of, for example, a hardening agent, catalyst and monomer which may occur during a period in which a thermosetting resin is fully hardened.

The electric insulation process of this invention is not limited to the aforesaid transformer coil. But the invention is applicable to a field coil of a rotor, a coil of a static electric implement such as a transformer, or any other electric implement loosely wound with an electric insulation layer which can be impregnated with a thermosetting resin.

What we claim is:

1. An electric implement which is constructed by impregnating a thermosetting resin in an electric insulation layer loosely wound about the peripheral surface of the electric implement, wherein a photohardening resin is further deposited on the surface of the impregnated thermosetting resin, said photohardening resin being selected from the group consisting of acrylic esters or methacrylic esters of polyhydric alcohol, and acrylic esters or methacrylic esters of polyester oligomers having a hydroxyl radical.

2. The electric implement according to claim 1, wherein the thermosetting resin is epoxy resin.

3. A method of electrically insulating an electric implement which comprises the steps of:

(i) impregnating an electric insulation layer loosely wound about the outer peripheral surface of an electric implement with a thermosetting resin in vacuum;

(ii) depositing a photohardening resin with atmospheric pressure on the thermosetting resin impregnated in the electric insulation layer wound about the outer peripheral surface of the electric implement, said photohardening resin being selected from the group consisting of acrylic esters or methacrylic esters of polyhydric alcohol and acrylic esters or methacrylic esters of polyester oligomers having a hydroxyl radical;

(iii) photopolymerizing the deposited photohardening resin by irradiating ultraviolet rays thereon; and (iv) thermally hardening the impregnated thermosetting resin.

4. The method according to claim 3, wherein step (i) comprises impregnating the electric insulation layer in vacuum with a solvent-free thermosetting resin having a viscosity of 0.1 to 10 poises at 60° to 70° C.

5. The method according to claim 3, wherein step (ii) comprises depositing a photohardening resin having a viscosity of 10 to 100 poises at normal temperature.

6. The method according to claim 3, wherein, during step (i), the electric implement is heated before the impregnation of the thermosetting resin.

7. The method according to claim 6, wherein the preheating temperature is set at 100° C.

8. A method according to claim 3, wherein said photohardening resin has a viscosity higher than that of the thermosetting resin.

9. The implement of claim 1 wherein said photohardening resin has a viscosity higher than that of the thermosetting resin.

* * * * *